US007399042B2

(12) United States Patent
Umeda

(10) Patent No.: US 7,399,042 B2
(45) Date of Patent: Jul. 15, 2008

(54) HEAD DRIVING DEVICE

(75) Inventor: Atsushi Umeda, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 339 days.

(21) Appl. No.: 11/094,509

(22) Filed: Mar. 31, 2005

(65) Prior Publication Data

US 2005/0225579 A1 Oct. 13, 2005

(30) Foreign Application Priority Data

Mar. 31, 2004 (JP) ..... P2004-101740
Mar. 31, 2004 (JP) ..... P2004-102921
Mar. 14, 2005 (JP) ..... P2005-071332
Mar. 14, 2005 (JP) ..... P2005-071333

(51) Int. Cl.
*B41J 29/38* (2006.01)

(52) U.S. Cl. ..... 347/5; 347/9; 347/10

(58) Field of Classification Search ..... 347/9, 347/10, 11, 12, 68, 69, 5
See application file for complete search history.

(56) References Cited

U.S. PATENT DOCUMENTS 6,046,613 A 4/2000 Tamura
6,123,415 A 9/2000 Nagato et al.
6,431,674 B2 8/2002 Suzuki et al.
6,811,238 B2 11/2004 Shingyohuchi
2002/0145637 A1* 10/2002 Umeda et al. ..... 347/9
2004/0113959 A1* 6/2004 Tamura ..... 347/9

FOREIGN PATENT DOCUMENTS

| | | |
|---|---|---|
| JP | 9-193392 | 7/1997 |
| JP | 9-201960 | 8/1997 |
| JP | 10-000773 | 1/1998 |
| JP | 10-291308 | 11/1998 |
| JP | 11-170529 | 6/1999 |
| JP | 2000-211126 A | 8/2000 |
| JP | 2000-263792 | 9/2000 |
| JP | 2002-96466 | 4/2002 |
| JP | 2002-264325 A | 9/2002 |
| JP | 2004-174872 | 6/2004 |

* cited by examiner

*Primary Examiner*—Lam S Nguyen
(74) *Attorney, Agent, or Firm*—Sughrue Mion, PLLC

(57) ABSTRACT

A head driving device of a liquid ejecting apparatus includes a pressure generating element, a bias voltage applying unit which applies a bias voltage to the pressure generating element, a driving voltage generating unit which generates and outputs a driving voltage to the pressure generating element for ejecting a liquid droplet from a nozzle of a liquid ejecting head, and a cutoff unit which cuts off the bias voltage applied to the pressure generating element based on an outputting of a drive stopping signal.

7 Claims, 6 Drawing Sheets

HEAD DRIVING DEVICE

BACKGROUND OF THE INVENTION

The present invention relates to a head driving device for driving various portions of a liquid ejecting head.

In a related art, there is proposed a circuit for driving a printing head with an object of enabling to eject ink stably from a nozzle opening even when a number of pressure generating elements (for example, piezoelectric elements) to be driven is varied. The related printing head driving circuit applies a predetermined potential (correcting potential) from a first switching speed correcting circuit and a second switching speed correcting circuit to a base of a transistor at a post stage of transistors connected in Derlington connection in a drive signal outputting circuit via a terminal for applying the correcting potential, thereby, it is possible to execute assisting injection of charge to the base of the transistor at the post stage or assisting flow out of charge from the base. As a result, a switching speed of the transistor of the post stage can arbitrarily be corrected in accordance with the potential applied to the terminal for applying the collecting potential (refer to, for example, JP-A-2000-211126).

Meanwhile, according to a related printing head driving circuit shown in FIG. 7, by making a potential of a drive voltage transmitting line 11 for connecting a power amplifying circuit 3 and an analog switch 7 or the like on a side of a printing head 5 (hereinafter, described as "COM potential") coincide with a bias potential of a piezoelectric element 9 when printing is stopped, stability of printing is increased and service life of the piezoelectric element 9 is also prolonged. However, an output voltage from a direct current power source of 42V is applied to a side of a drive voltage generating circuit 1 including the power amplifying circuit 3 as a drive power source. Also, charge charged from a direct current power source of 5V to a capacitor 15 via a resistor 13 is applied to the side of the piezoelectric element 9 as the bias voltage of the piezoelectric element 9. Therefore, a potential difference is produced between the COM potential and the bias potential of the piezoelectric element 9. As a result, a leak current is made to flow to the piezoelectric element 9 through the drive voltage transmitting line 11. Therefore, there poses a problem that a power consumption amount of the printer at standby state is considerable.

Further, in the related printing head driving circuit shown in FIG. 7, a capacitance of an (electrolytic) capacitor 15 for applying a bias voltage to respective piezoelectric elements 9 is far larger than a capacitance of a plurality of pieces of the piezoelectric elements 9 (in FIG. 7, only one piece of the piezoelectric element designated by numeral 9 is illustrated for convenience of illustration and explanation) provided at respective nozzles. This is because whereas a piezoelectric element having a small capacitance equal to or smaller than, for example, 1 μF is used for each of the piezoelectric elements 9, an (electrolytic) capacitor having a large capacity of about, for example, 4000 μF is used for the (electrolytic) capacitor 15.

The reason of using the (electrolytic) capacitor having the capacitance far larger than the capacitance of the piezoelectric elements 9 in this way as the capacitor 15 is that a voltage charged to the capacitor 15 through a resistor 13 (of, for example, 400μΩ) from a direct current power source (of, for example, 5V) is applied from the capacitor 15 to the respective piezoelectric elements 9 as the bias voltage. In other words, since the capacitor 15 achieves a function as a storage battery, the capacitor having the large capacitance needs to use as the capacitor 15. Therefore, a time constant (CR) determined by a product of the capacitance (4000 μF) of the capacitor 15 by a resistance value (4000μΩ) of the resistor 13 is large and therefore, time is taken for charging the capacitor 15 until an output voltage from the capacitor 15 reaches the above-described power source voltage (for example, 5V) (for example, about several second are required).

The printing head driving circuit illustrated in FIG. 7 does not pose a serious problem even when time is taken in charging the above-described capacitor 15 from the above described direct current power source, in the case in which the drive power source is temporarily made OFF to stop printing operation of the printer and thereafter, the drive power source is made ON again to restart the printing operation of the printer. Because normally, the printer needs a time period to some degree until the printing operation can be carried out since the drive power source has been switched on. However, there is a case in which the printer is intended to be brought into a standby state (awaiting state) by temporarily stopping to charge the capacitor 15 from the direct current power source of 5V for saving power or the like. In that case, when time is taken in charging the capacitor 15 as described above, there poses a problem that time is taken for recovering the printer from the standby state to a state of capable of carrying out printing operation.

SUMMARY OF THE INVENTION

It is therefore a first object of the present invention to provide a head driving device capable of saving power by restraining a power consumption amount of a liquid ejecting apparatus at standby state.

Further, it is a second object of the invention to provide a head driving device capable of recovering to a state for restart liquid ejecting operation in a short period of time from a standby state.

In order to achieve the above object, according to the present invention, there is provided a head driving device of a liquid ejecting apparatus, comprising:

a pressure generating element;

a bias voltage applying unit which applies a bias voltage to the pressure generating element;

a driving voltage generating unit which generates and outputs a driving voltage to the pressure generating element for ejecting a liquid droplet from a nozzle of a liquid ejecting head; and a cutoff unit which cuts off the bias voltage applied to the pressure generating element based on a drive stopping signal.

Preferably, the bias voltage applying unit is supplied with a power from a first power source for charging. A voltage of the first power source is lower than a voltage of a second power source for supplying a power to the driving voltage generating unit for charging.

Preferably, the cutoff unit forms a circuit for discharging a charge which is charged on the bias voltage applying unit when the drive stopping signal is outputted.

Preferably, the cutoff unit forms a circuit for charging the bias voltage applying unit by supplying the power from the first power source to the bias voltage applying unit when the drive stopping signal is not outputted.

Preferably, the cutoff unit forms a circuit for charging the bias voltage applying unit by supplying the power from the second power source to the bias voltage applying unit when the drive stopping signal is not outputted.

Preferably, the circuit is formed based on a drive instruction signal which is outputted when the liquid ejecting head restarts a liquid ejecting operation from a standby state.

According to the present invention, there is also provided a head driving device of a liquid ejecting apparatus, comprising:

a pressure generating element;

a bias voltage applying unit which applies a bias voltage to the pressure generating element;

a driving voltage generating unit which generates and outputs a driving voltage to the pressure generating element for ejecting a liquid droplet from a nozzle of a liquid ejecting head;

a first charging unit which charges the bias voltage applying unit at a first voltage; and a second charging unit which charges the bias voltage applying unit at a second voltage greater than the first voltage when a drive instruction signal is outputted to the a driving voltage generating unit.

Preferably, the second voltage is a voltage outputted from the driving voltage generating unit.

Preferably, the drive instruction signal is a signal outputted when the liquid ejecting head restarts a liquid ejecting operation from a standby state.

Preferably, the second charging unit charges the bias voltage applying unit at a first charge time period shorter than a second charge time period for charging the bias voltage applying unit by the first charging unit.

Preferably, the head driving device further comprising a cutoff unit which cuts off the bias voltage applied to the pressure generating element when a drive stopping signal is outputted to the driving voltage generating unit.

According to the present invention, there is also provided a method of cutting-off an applied voltage to a pressure generating element of a head driving device of a liquid ejecting apparatus, comprising:

applying a bias voltage to the pressure generating element;

generating and outputting a driving voltage to the pressure generating element for ejecting a liquid droplet from a nozzle; and cutting-off the bias voltage applied to the pressure generating element based on a drive stopping signal.

According to the present invention, there is also provided a method of charging a bias voltage applying unit for applying a bias voltage to a pressure generating element of a head driving device of a liquid ejecting apparatus, comprising:

applying a bias voltage to the pressure generating element;

generating and outputting a driving voltage to the pressure generating element for ejecting a liquid droplet from a nozzle of a liquid ejecting head;

charging the bias voltage applying unit at a first voltage; and charging the bias voltage applying unit at a second voltage greater than the first voltage when a drive-instruction signal is outputted to the a driving voltage generating unit.

According to the invention, there can be provided the head driving device capable of saving power by restraining a power consumption amount when the liquid ejecting apparatus is at standby.

Further, according to the invention, there can be provided the head driving device in which liquid ejecting operation is recovered to a restartable state in a short period of time when the liquid ejecting apparatus is brought into the standby state.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Embodiments of the invention will be explained in details in reference to the drawings as follows.

Figure 1:
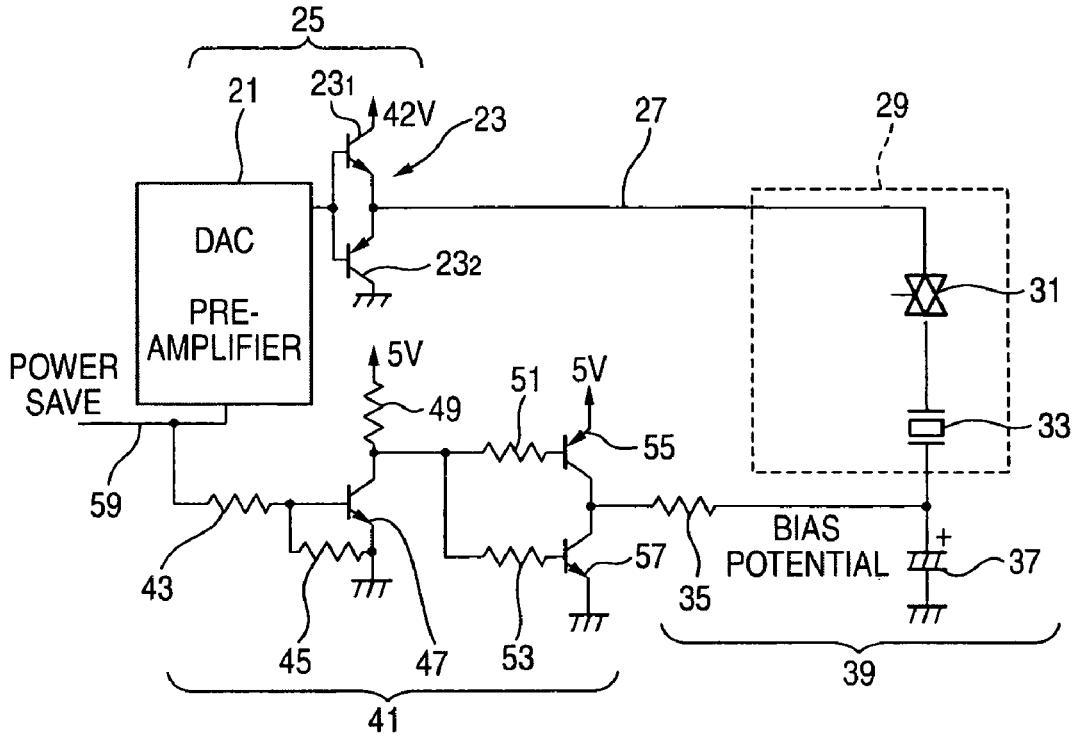
FIG. 1 is a circuit constitution diagram of a printing head driving circuit according to a first embodiment of the invention.

FIG. 1 is a circuit constitution diagram of a printing head driving circuit according to a first embodiment of the invention.

In FIG. 1, a power amplifier 23 constituting a trapezoidal wave voltage generating circuit 25 along with a D/A converter (hereinafter, described as "DAC") designated by numeral 21 and a preamplifier is connected to an analog switch 31 and a piezoelectric element 33 on a side of a printing head 29 through a drive voltage transmitting line 27. The power amplifier 23 is connected to an NPN power transistor $\mathbf{23}_1$ and a PNP power transistor $\mathbf{23}_2$ in push pull connection manner. An output voltage from a direct current power source of 42V is applied to the power amplifier 23.

The trapezoidal wave voltage generating circuit 25 generates a trapezoidal wave voltage in accordance with a drive instruction signal outputted from an ASIC (Application Specific Integrated Circuit) (not illustrated) to the DAC and outputs the trapezoidal wave voltage to the printing head 29 through the drive voltage transmitting line 27. The trapezoidal wave voltage generating circuit 25 stops generating the trapezoidal wave voltage when a voltage signal of a logical level 'L' is outputted from ASIC (not illustrated) to the DAC as a power save signal.

On the other hand, the piezoelectric element 33 is connected with a bias voltage supplying circuit 39 having a resistor 35 and an (electrolytic) capacitor 37. The bias voltage supplying circuit 39 is connected with a bias voltage controlling circuit 41 for controlling to charge the capacitor 37 from a direct current power source of 5V through the resistor 35 and discharge the capacitor 37 to the ground through the resistor 35 based on an instruction signal (the drive instruction signal or power save signal) from ASIC (not illustrated). The bias voltage controlling circuit 41 is provided with a resistor 43, a resistor 45, an NPN transistor (hereinafter, abbreviated as "TR") 47 (the same as follows) constituting a cutoff unit, a resistor 49, a resistor 51, a resistor 53, a PNP transistor (hereinafter, abbreviated as "TR") 55, and TR57 (the same as follows) constituting the cutoff unit along with TR47. A first switching circuit is constituted by the resistor 43, the resistor 45, TR47 and the resistor 49, and a second switching circuit is constituted by the resistor 51, the resistor 53, TR55 and TR57, respectively.

In the first switching circuit, the resistor 43 is connected between a control signal transmitting line 59 connected to, for example, ASIC (not illustrated) and a base of TR47. The resistor 45 is connected between the base and an emitter of TR47. The resistor 49 is connected between the 5V power source and a collector of the TR47. The TR47 is brought into a conductive state (turned on) by applying a voltage signal of a logical level 'H' as the drive instruction signal from the control signal transmitting line 59 to the base through the resistor 43.

In the second switch circuit, an emitter side of TR55 is connected to the direct current power source of 5V, a collector side thereof is connected to a collector of the TR57 and the resistor 35 (of the bias voltage supplying circuit 39), and a base thereof is connected to the resistor 51, respectively. Further, the collector side of TR57 is connected to the collector of TR55 and the resistor 35 (of the bias voltage supplying circuit 39), a base side thereof is connected to the resistor 53 and an emitter side thereof is connected to the ground. The resistor 51 is connected between the collector of TR47 (of the first switching circuit) and the base of TR55. The resistor 53 is connected between the collector of TR47 (of the first switching circuit) and the base of TR57. TR55 becomes conductive by making the TR47 (of the first switching circuit) conductive and becomes nonconductive by making TR47 nonconductive. On the other hand, TR57 becomes conductive by making TR47 nonconductive and becomes nonconductive by making TR47 conductive.

In the constitution, when the drive instruction signal is outputted from ASIC (not illustrated) to DAC (of the trapezoidal wave voltage generating circuit 25) in order to execute printing operation by the printing head 29, thereby, the trapezoidal wave voltage is started to generate at the trapezoidal wave voltage generating circuit 25 and the printing head 29 starts printing operation. As a result, the potential of the drive voltage transmitting line 27, that is, the COM potential is varied upward/downward centering on a middle potential (for example, about 20V). On the other hand, the drive instruction signal is also applied to the bias voltage controlling circuit 41 in synchronism with application to the DAC. When the drive instruction signal is applied to the base of TR47 through the resistor 43, TR47 is conducted and the corrector potential of TR47 becomes substantially 0V and a closed circuit reaching the ground from the 5V power source through the resistor 49 and TR47 is formed. Thereby, the base potential of TR55 is lowered down to a voltage value higher than substantially 0V by an amount of a voltage drop of the resistor 51 and therefore, TR55 is conducted and the capacitor 37 is charged from the 5V direct current power source through TR55 and the resistor 35. Here, since the corrector potential of TR47 becomes substantially 0V, TR57 maintains the nonconductive state.

Contrary to the above described, when the power save signal (that is, the voltage signal of the logical level 'L') is outputted from ASIC (not illustrated) to DAC (of the trapezoidal wave voltage generating circuit 25) in order to temporarily stop printing operation by the printing head 29, thereby, the trapezoidal wave voltage generating circuit 25 stops generating the trapezoidal wave voltage so that the printing head 29 stops printing operation. As a result, the COM potential becomes substantially 0V. The power save signal is applied also to the bias voltage controlling circuit 41 in synchronism with application to the DAC. When the power save signal is applied to the base of TR47 through the resistor 43, TR47 is switched from a conductive state to an nonconductive state, the corrector potential of TR47 rises from substantially 0V to a value constituted by subtracting an amount of the voltage drop of the resistor 49 from the output voltage (5V) of the direct current power source. Thereby, TR55 is switched from a conductive state to an nonconductive state. On the other hand, the base potential of TR57 rises from substantially 0V up to a value constituted by subtracting the amount of the voltage drop of the resistor 49 and an amount of a voltage drop of the resistor 53 from the output voltage (5V) of the direct current power source of 5V. As a result, TR57 is switched from an nonconductive state to a conductive state, a closed circuit reaching the ground from the capacitor 37 through the resistor 35 and TR57 is formed, charge accumulated-at-the capacitor 37 is discharged from the capacitor 37 to the ground through the resistor 35 and TR57. As a result, also the bias potential becomes substantially 0V. That is, by switching TR47 from the conductive state to the nonconductive state and switching TR57 from the nonconductive state to the conductive state, when a driving stop signal is outputted to the drive voltage generating unit (trapezoidal wave voltage generating circuit 25), in synchronism with an output of the driving stop signal, the output of the bias voltage to a nozzle driving unit (piezoelectric element 33) by the bias voltage applying unit (capacitor 37) is cutoff.

Figure 2:
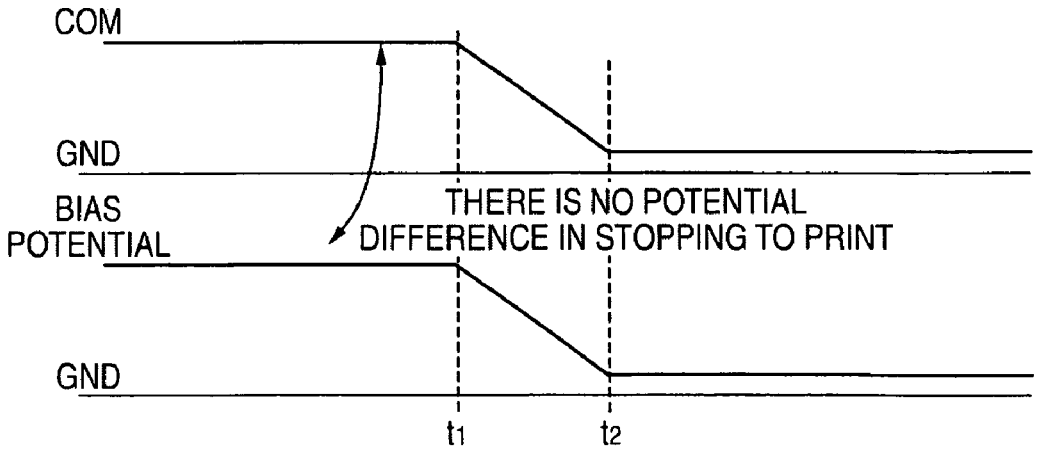
FIG. 2 is a timing chart showing a relationship between a transition of a COM potential and a transition of a bias potential.

FIG. 2 is a timing chart showing a relationship between a transition of the COM potential and a transition of the bias potential.

In FIG. 2, when the power save signal, that is, the voltage signal at the logical level 'L' is outputted from ASIC (not illustrated) at time $t_1$, both of the COM potential and the bias potential are gradually lowered and the both potentials become substantially 0V at time $t_2$. At time $t_2$, there is not a potential difference between the COM potential and the bias potential.

According to the first embodiment of the invention, stability of printing can be increased and service life of the piezoelectric element 9 can be prolonged, the potential difference between the COM potential and the bias potential can be eliminated and therefore, also the power can be saved by restraining the power consumption amount of the printer at standby.

Figure 3:
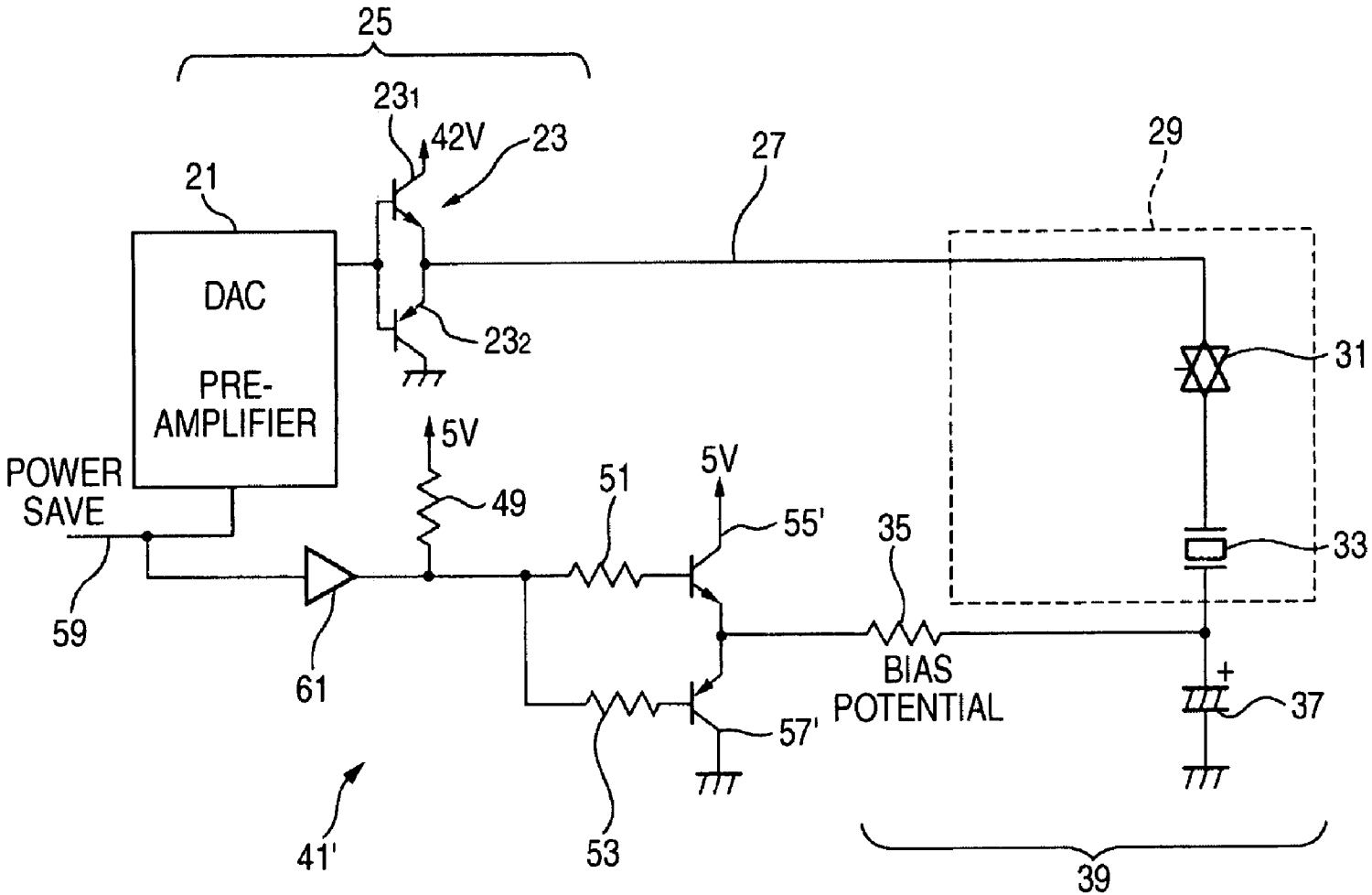
FIG. 3 is a circuit constitution diagram of a printing head driving circuit according to a second embodiment of the invention.

FIG. 3 is a circuit constitution diagram of a printing head driving circuit according to a second embodiment of the invention.

According to the second embodiment, a constitution of a bias voltage controlling circuit is different from that of the bias voltage controlling circuit 41 illustrated in FIG. 1 in that the resistor 43, the resistor 45 and TR47 of the first switching circuit are removed from the bias voltage controlling circuit 41 shown in FIG. 1, that is, a buffer 61 is provided in place of them, and further, a PNP transistor is used in place of TR55 of the second switching circuit, an NPN transistor is used in place of TR57 to use as TR55' and the cutoff unit, that is, TR57' (the same as follows). The other constitution is similar to that illustrated in FIG. 1 and therefore, portions in FIG. 3 the same as those illustrated in FIG. 1 are attached with the same numerals and an explanation thereof will be omitted.

A voltage level of a control signal (drive instruction signal) transmitted from ASIC (not illustrated) to the trapezoidal wave voltage generating circuit and a bias voltage controlling circuit 41' is, for example, 3.3V. The buffer 61 is provided with a function of converting the voltage level of the control signal from 3.3V to 5V.

When the drive instruction signal of 3.3V is applied from the side of ASIC (not illustrated) (to the bias voltage controlling circuit 41') in the bias voltage controlling circuit 41' having the aboveescribed constitution, base potentials of TR55', TR57' rise. Therefore, TR55' is conducted and TR57' is brought into an nonconductive state. As a result, a closed circuit reaching the ground from the direct current power source of 5V through TR55', the resistor 35 and the capacitor 37 and therefore, the capacitor 37 is charged from the direct current power source of 5V. On the other hand, when the power save signal is applied from the side of ASIC (not illustrated) (to the bias voltage controlling circuit 41'), thereby, the base potentials of TR55', TR57' are lowered and therefore, TR57' is conducted and TR55' is brought into an nonconductive state. As a result, charge accumulated at the capacitor 37 is discharged through the resistor 35, and TR57'.

Also in the second embodiment, an effect similar to that in the first embodiment of the invention can be achieved.

Figure 4:
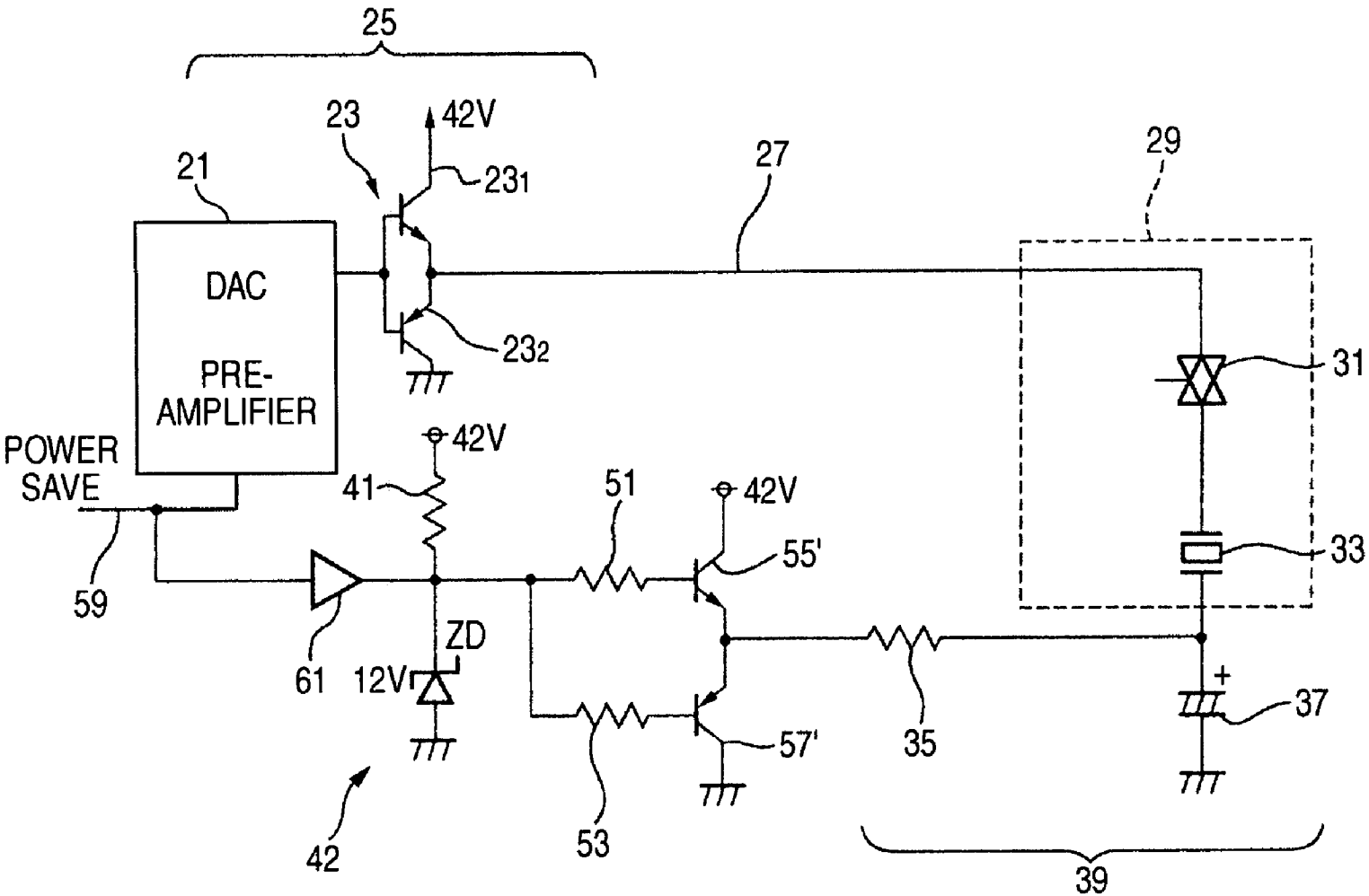
FIG. 4 is a circuit constitution diagram of a printing head driving circuit according to a third embodiment of the invention.

FIG. 4 is a circuit constitution diagram of a printing head driving circuit according to a third embodiment of the invention.

According to the second embodiment, a constitution of a bias voltage controlling circuit is different from that of the bias voltage controlling circuit 41' illustrated in FIG. 3 in that a Zener diode ZD63 having a Zener voltage ($V_z$) of, for example, 12V is connected between the ground and a control signal transmitting line 59' which is connected to a resistor 41 of a first switching circuit, the resistor 51, the resistor 53 and the buffer 61 of the second switching circuit respectively, and a direct current power source connected with the resistor 41 and a direct current power source connected with TR55' are replaced to direct current power sources of 42V from the direct current power sources of 5V. The other constitution is similar to that illustrated in FIG. 3, and therefore in FIG. 4, portions the same as those illustrated in FIG. 3 are attached with the same numerals and an explanation thereof will be omitted.

In the bias voltage controlling circuit 42 having the above-described constitution, when the drive instruction signal (voltage signal at the logical level 'H') is applied from ASIC (not illustrated) to the bias voltage controlling circuit 42 through the control signal line 59 in order to recover the printer from the standby state to the state of capable of executing printing operation, the base potentials of TR55' and a cutoff unit, that is, TR57' (the same as follows) rise by an amount of, for example, 5V from a value constituted by subtracting an amount of the voltage drop at the resistor 51 from $V_2$(=12V). Thereby, TR55' is conducted and TR57' is brought into the nonconductive state. As a result, a closed circuit reaching the ground from the direct current power source of 42V through TR55', the resistor 35 and the capacitor 37 is formed and therefore, the capacitor 37 is charged from the direct current power source of 42V by a direct current voltage of, for example, about 11V (by voltage drop at the resistor 35). In this case, the supply voltage is switched to the direct current voltage of 42V from the direct current voltage of 5V and therefore, even when a capacitance of the capacitor 37 is as larger as, for example, 4000 μF, the voltage of charging the capacitor 37 reaches a predetermined value (for example, 5V) in a comparatively short period of time.

Figure 5:
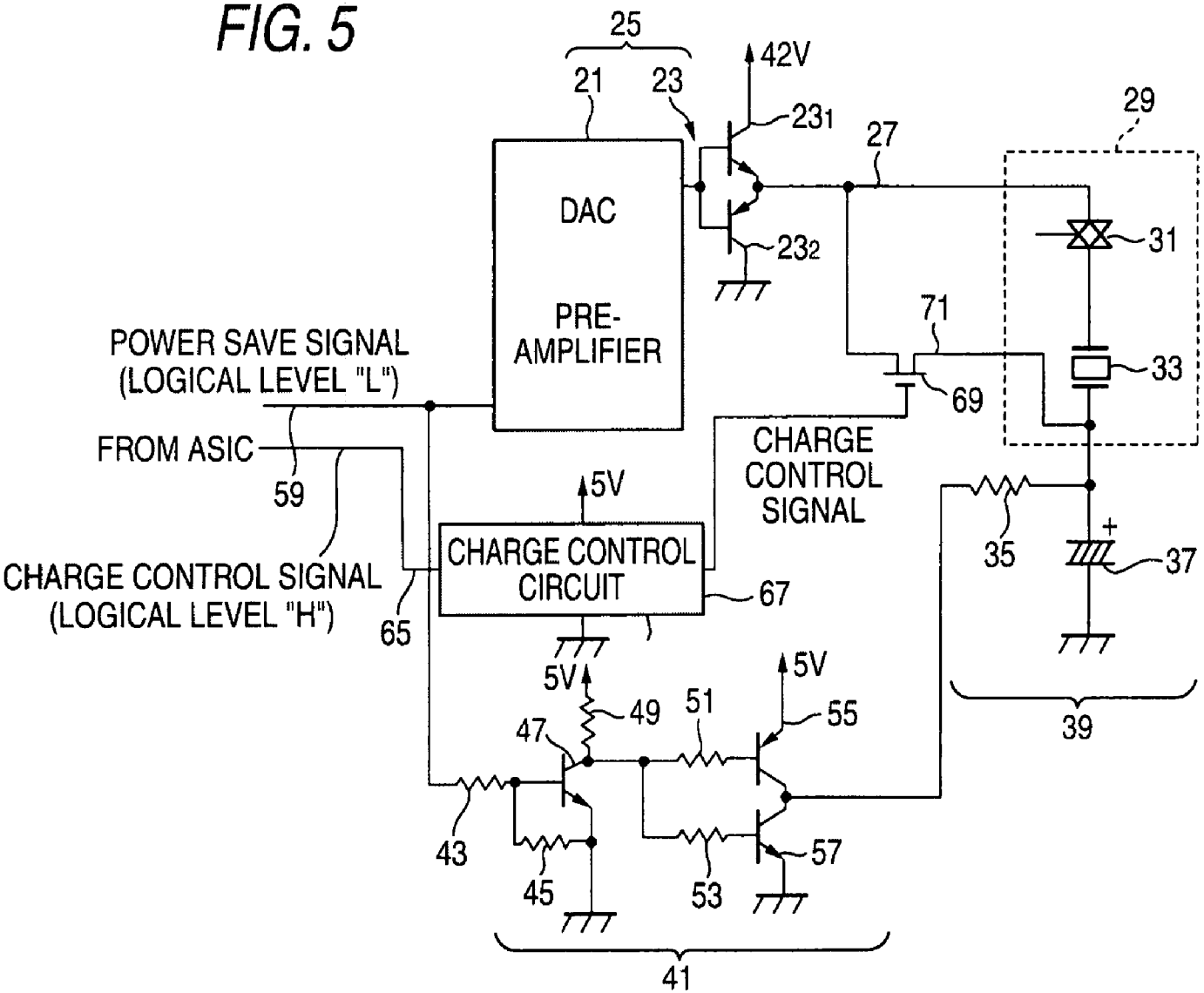
FIG. 5 is a circuit constitution diagram of a printing head driving circuit according to a fourth embodiment of the invention.

FIG. 5 is a circuit constitution diagram of a printing head driving circuit according to a fourth embodiment of the invention.

According to the fourth embodiment, a constitution of the printing head driving circuit is different from that of the printing head driving circuit illustrated in FIG. 5 in that a control signal transmitting line 65, a second charging unit, that is, a charge controlling circuit 67 (same as follows), a semiconductor switching element 69, and a rapid charging line 71 are added to the portions of the printing head driving circuit illustrated in FIG. 1. Here, the bias voltage controlling circuit 41 serves as a first charging unit.

The rapid charging line 71 connects an output side of the power amplifier 23 and the (electrolytic) capacitor 37, and the rapid charging line 71 is connected with the semiconductor switching element 69. The semiconductor switching element 69 is operated to be made ON/OFF by a charge control signal applied from the charge controlling circuit 67. By operating to make the semiconductor switching element 69 ON, the trapezoidal wave voltage outputted through-the power amplifier 23 is supplied to the (electrolytic) capacitor 37 through the rapid charging line 71. Further, the control signal transmitting line 65 connects ASIC (not illustrated) and the charge controlling circuit 67 independently from the control signal transmitting line 59. The charge controlling circuit 67 outputs the charge control signal to the semiconductor switching element 69 in accordance with the instruction signal transmitted from ASIC (not illustrated) through the control signal transmitting line 65.

In the above configuration, the operation for printing of the printing head 29 of this fourth embodiment is substantially same as that of the first embodiment. However, when the printer brought into the standby state (awaiting state) by temporally stopping to charge the (electrolytic) capacitor 37 from the direct current power source of 5V for saving power or the like is recovered to a state of capable of carrying out the printing operation, the drive instruction signal (voltage signal at the logical level 'H') is applied from ASIC (not illustrated) to DAC and the bias voltage controlling circuit 41 through the control signal line 59, also the drive instruction signal is applied to the charge controlling circuit 67 through the control signal transmitting line 65. Thereby, the capacitor 37 is charged from the direct current power source of 5V through the bias voltage controlling circuit 41 and the resistor 35 and the capacitor 37 is charged from the direct current power source of 42V through the power amplifier 23 and the rapid charging line 71 by operating to make the semiconductor switching element 69 ON by the charge control signal from the charge controlling circuit 67.

The capacitor 37 is stopped from being charged through the rapid charging line 71. This stopping of the charge is separate from an outputting of the power save signal (voltage signal at the logical level 'L') from ASIC (not illustrated) to the side of the trapezoidal wave voltage generating circuit through the control signal transmitting line 59. That is, a stopping of the charging operation through the rapid charging line 71 is based on a charge stop control signal applied to the charge controlling circuit 67 through the control signal transmitting line 65 from ASIC (not illustrated). The semiconductor switching element 69 is turned OFF to stop the charging operation in accordance with the charge stop instruction signal applied from the charge controlling circuit 67 to the semiconductor switching element 69.

Figure 6:
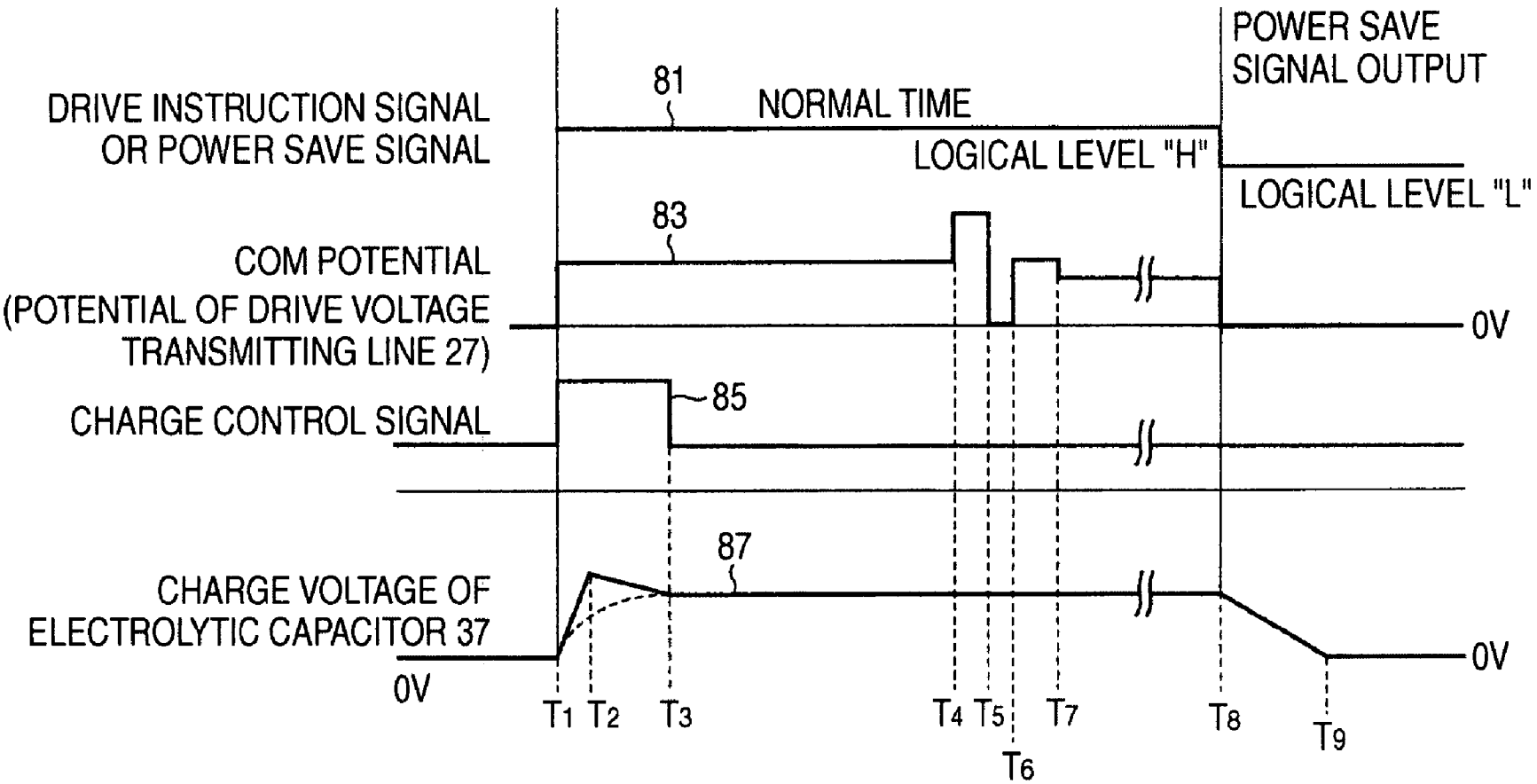
FIG. 6 is a timing chart showing operation of various portions of the printing head driving circuit illustrated in FIG. 5.
Figure 7:
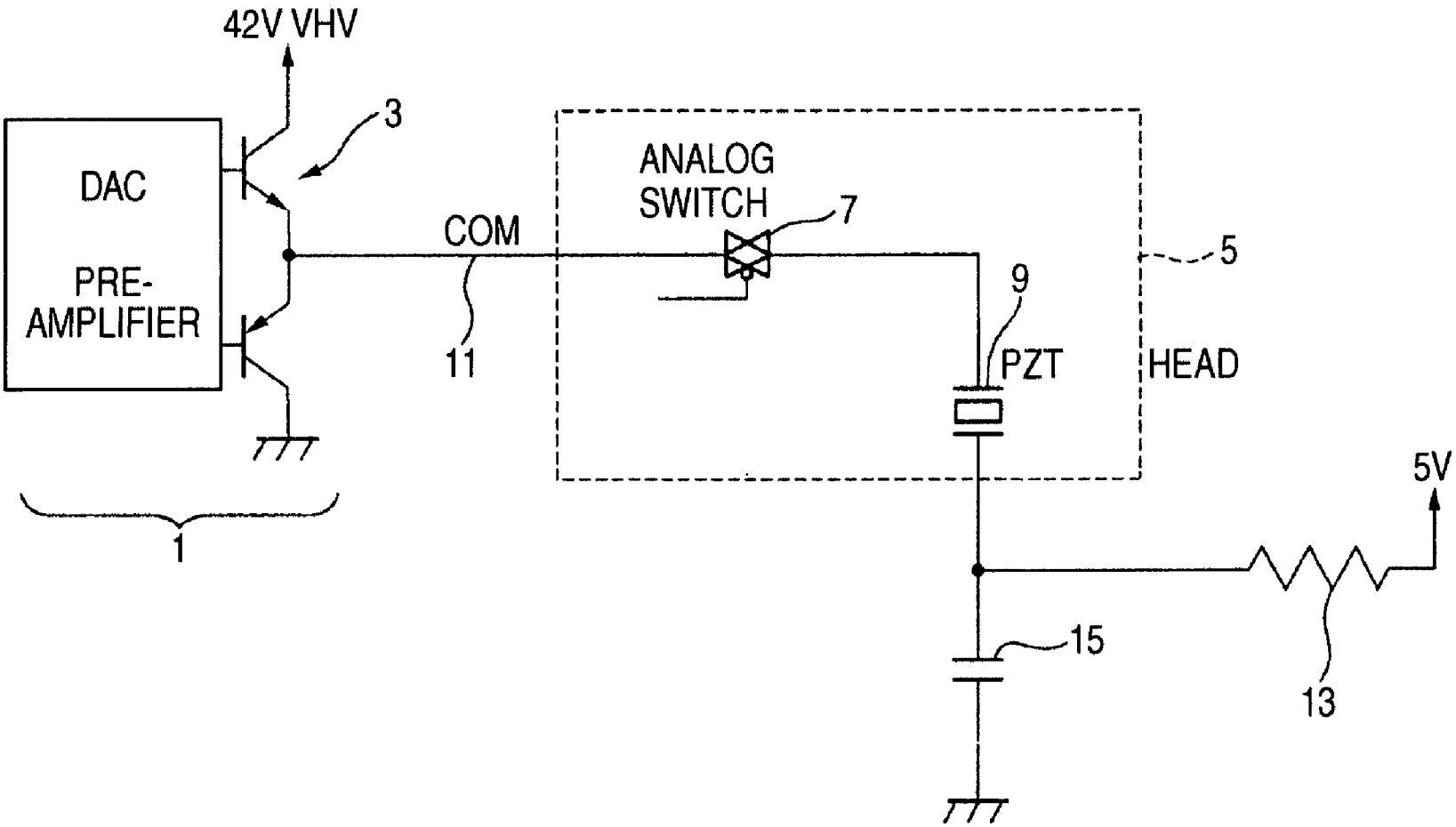
FIG. 7 is a circuit constitution diagram of a related printing head driving circuit.

FIG. 6 is a timing chart showing operation of respective portions of the printing head driving circuit illustrated in FIG. 5.

In FIG. 6, at time T1, when a drive instruction signal 81 is outputted from ASIC (not illustrated) to the trapezoidal wave voltage generating circuit and the bias voltage controlling circuit 41 respectively and further a charge control signal 85 is outputted (ON) from ASIC (not illustrated) to the charge controlling circuit 67, a COM potential 83 rises from 0V to a predetermined potential with a constant inclination. On the other hand, a charge voltage 87 of the capacitor 37 temporarily exceeds 5V at previously programmed predetermined time T2 by charging from the direct current power source of 5V through the bias voltage controlling circuit 41 and charging in the trapezoidal waveform from DAC through the power amplifier 23 and the rapid charging line 71 and thereafter becomes 5V constituting predetermined rise of voltage at time T3.

At time T3, the charge control signal 85 is made OFF (logical level becomes 'L'). At time T3 and thereafter, the charge control signal 85 is not made ON again. Next at time T4, T5, T6, and T7, the COM potential is varied upward and downward in accordance with a value of the trapezoidal wave voltage outputted from the trapezoidal wave voltage generating circuit. Further, at T8, when the power save signal (logical level 'L') is outputted from ASIC (not illustrated) to the trapezoidal wave voltage generating circuit and the bias voltage controlling circuit 41, the COM potential immediately becomes 0V and the charge voltage of the capacitor 37 becomes 0V at time T9 after elapse of a predetermined time period from time T8.

Although the preferable embodiments of the invention have been explained, the embodiments are only exemplifications for explaining the invention and do not limit the scope of the invention only to the embodiments. The invention can be embodied also in other various modes for carrying out the invention.

What is claimed is:

1. A head driving device of a liquid ejecting apparatus, comprising:

a pressure generating element;

a bias voltage applying unit operable to apply a bias voltage to the pressure generating element;

a driving voltage generating unit operable to convert a digital signal into an analog signal and amplify the analog signal to generate and output a driving voltage to the pressure generating element for ejecting a liquid droplet from a nozzle of a liquid ejecting head; and a cutoff unit operable to cut off the bias voltage applied to the pressure generating element based on a drive stopping signal, wherein when the drive stopping signal is input to the bias voltage applying unit and the driving voltage generating unit in synchronism, the driving voltage generating unit stops generating the driving voltage and the cutoff unit cuts of the bias voltage in synchronization with the drive stopping signal, so as to put the liquid ejecting apparatus into a standby state, wherein the bias voltage applying unit is supplied with a power from a first power source for charging, and wherein a voltage of the first power source is lower than a voltage of a second power source for supplying a power to the driving voltage generating unit for charging.

2. The head driving device as set forth in claim 1, wherein the cutoff unit discharges a charge which is charged on the bias voltage applying unit when the drive stopping signal is input to the driving voltage generating unit.

3. The head driving device asset forth in claim 1, wherein the cutoff unit forms a circuit for charging the bias voltage applying unit by supplying the power from the first power source to the bias voltage applying unit when the drive stopping signal is not outputted.

4. The head driving device as set forth in claim 3, wherein the circuit is formed based on a drive instruction signal which is outputted when the liquid ejecting head restarts a liquid ejecting operation from a standby state.

5. The head driving device as set forth in claim 1, wherein the cutoff unit forms a circuit for charging the bias voltage applying unit by supplying the power from the second power source to the bias voltage applying unit when the drive stopping signal is not outputted.

6. The head driving device as set forth in claim 5, wherein the circuit is formed based on a drive instruction signal which is outputted when the liquid ejecting head restarts a liquid ejecting operation from a standby state.

7. A method of cutting-off an applied voltage to a pressure generating element of a head driving device of a liquid ejecting apparatus, comprising:

applying a bias voltage to the pressure generating element by a bias voltage applying unit;

converting a digital signal into an analog signal and amplifying the analog signal to generate a driving voltage in a driving voltage generating unit;

outputting the driving voltage to the pressure generating element for ejecting a liquid droplet from a nozzle;

when a drive stopping signal is input to the bias voltage applying unit and the driving voltage generating unit in synchronism, stopping generating the driving voltage and cutting-off the bias voltage in synchronization with the drive stopping signal, so as to put the liquid ejecting apparatus into a state, wherein the bias voltage applying unit is supplied with a power from a first power source for charging, and wherein a voltage of the first power source is lower than a voltage of a second power source for supplying a power to the driving voltage generating unit for charging.

* * * * *